US006336876B1

(12) United States Patent
Moore

(10) Patent No.: US 6,336,876 B1
(45) Date of Patent: Jan. 8, 2002

(54) TEAM WATER SPORT AND METHOD OF PLAY

(76) Inventor: Tom R. Moore, 7578 Broadview Farms La., Tallahassee, FL (US) 32308

( * ) Notice: Subject to any disclaimer, the term of this patent is extended or adjusted under 35 U.S.C. 154(b) by 0 days.

(21) Appl. No.: 09/369,251

(22) Filed: Aug. 6, 1999

Related U.S. Application Data

(63) Continuation-in-part of application No. 09/272,173, filed on Mar. 18, 1999.

(51) Int. Cl.[7] ..... A63B 67/00
(52) U.S. Cl. ..... 473/466; 273/348.2
(58) Field of Search ..... 473/466, 465, 473/471; 273/348.2

(56) References Cited

U.S. PATENT DOCUMENTS

| | | | | |
|---|---|---|---|---|
| 4,360,206 A | * | 11/1982 | Bian | 273/348.2 |
| 4,759,545 A | * | 7/1988 | Grable | 473/481 |
| 5,456,462 A | * | 10/1995 | Wilson | 473/502 |
| 5,499,822 A | | 3/1996 | Sabourin | |
| 5,516,098 A | | 5/1996 | Aiello | |
| 5,722,906 A | | 3/1998 | Gentile | |

OTHER PUBLICATIONS

USAWP Playing rules wysiwyg://AnswerFrame.27/http://waterpolo.jmu.edu/rules, 1998.*
Watch water polo www.waterpolo.ca/media/media8.htm, Jan. 5, 2001.*
Grandrabbits www.grtoys.com/items/SMA01001.asp—ad p. 1,2 for G Oct. 5, 2000.
Balls www.playworks.net/Balls.html—p. 1–3 Oct. 5, 2000.
Gertie Product Box front/rear panels—copyright 1996.
Google search website information (6 pgs) and Nov. 1, 1997 date for Gertie Balls—(1 pg) Oct. 5, 2000.

* cited by examiner

*Primary Examiner*—Jeanette Chapman
*Assistant Examiner*—M. Chambers
(74) *Attorney, Agent, or Firm*—Dowell & Dowell, P.C.

(57) ABSTRACT

A water sport to be played between two teams each having a number of players, including at least one goalie for each team together with offensive/defensive players. The sport is played utilizing a ball which is hand held and hand propelled and which is structured so as to promote skimming across the surface of water. Points are scored by propelling the game ball either parallel or downwardly relative to the surface of the water such that the ball must strike the water before entering a goal of at least one or more goals defended by each team.

8 Claims, 2 Drawing Sheets

TEAM WATER SPORT AND METHOD OF PLAY

CROSS REFERENCE TO RELATED APPLICATIONS

The application is a continuation-in-part application of U.S. patent application Ser. No. 09/272,173 filed Mar. 18, 1999.

BACKGROUND OF THE INVENTION

1. Field of the Invention

The present invention is generally directed to games specially developed for play in the water and more particularly to a new aquatic or water sport which involves the use of a hand held ball which is designed so as to promote skimming across the water surface and wherein the ball is advanced by players on opposing teams toward at least one and preferably two goals defended by each team with the ball being advanced by propulsion parallel to or downwardly inclined relative to the surface of the water toward the opposing team's goal or goals.

2. Brief Description of the Related Art

Team water sports are growing in popularity world-wide. Most such water sports are based upon variation of games which are played either on court surfaces or on fields. Examples of such sports are water polo which is played in a pool with teams defending separate goals and wherein the play is based upon the general concept developed from the sport of field polo or soccer, except the game ball is advanced by hand propulsion as opposed to being propelled by a mallet or by the foot of a player.

One of the unique features derived from water sports is the physical benefits obtained by participating in a rigorous activity without placing undue stress upon joints such as caused during running movements with respect to games which are played on solid surfaces.

Because of the benefits obtained by water sports and also the growing popularity, there is a need to develop new water sports which will pique the interest of individuals to participate in team activities which are physically and socially beneficial.

SUMMARY OF THE INVENTION

The present invention is directed to a water sport and method of playing the sport which utilizes a game ball designed to be manipulated by the hand of a player. The game is played with two teams each having a plurality of players and with each team defending at least one goal. In a preferred embodiment, the game is played such that each team must defend two goals and thus two of the players for each team are designated as goalies. The remaining players on each team act as offensive and defensive players. A preferred embodiment for play in an area of play typical of a conventional junior Olympic size pool includes five players for each team. The goals are preferably mounted at each corner of the pool or between corners of one end of the pool and at a corner defined by a line, such as a cable or rope, extending across a pool and the sides of the pool depending upon the configuration of the pod and the size of the area in which the game is to be played. More players may be involved when the game is played in an Olympic size pool or in water which is not defined by pool side walls, such as if the game is played in a lake.

The game ball is designed to float and thus not to sink beneath the water. Further, the game ball is slightly weighted with a free-flowing fluid to promote a skimming of the ball across the surface of the water when properly propelled. In accordance with the method of play, advancement of the ball is by hand propulsion with the ball being projected either parallel to or downwardly at an angle relative to the surface of the water. Unlike other aquatic or water sports, advancement of the ball is not allowed by lobbing or throwing the ball upwardly away from the water surface and, in keeping with this desire, the game ball must contact the surface of the water before entering an opposing team's goal in order for points to be awarded during game play.

In the method of play, a team determined to have the initial possession of the ball advances the ball toward the opposing team's goal. During advancement, the ball may be passed by propelling the ball as previously discussed between players of the same team. However, if a player having possession of the ball is contacted by an opposing player, possession is transferred to the opposite team.

In a preferred method of play, there are separately timed periods which, in one embodiment, includes four quarters of play each having the same length. A typical example would be four quarters of ten minutes length. Time is kept by an appropriate time keeper or official and a determination of a winning team is made by the number of points awarded for goals scored during the time of play. In some embodiments, the winning team must have a predetermined number of points greater than the losing team or additional time is permitted for game play until a predetermined point spread is obtained by the winning team.

In the preferred method of game play, there is a portion of the play area which is defined as a crease and no player from an advancing team may enter the crease during game play and, if such a player is within the crease when a goal is scored, such goal will not count.

Possession automatically changes to an opposing team upon the scoring of a goal or upon the award of penalties as determined by the rules of game play, as will be set forth in greater detail hereinafter.

It is the primary object of the present invention to provide a new type of aquatic or water sport which is designed for team play wherein each team advances a ball which is designed to be hand propelled in parallel or converging relationship with respect to the surface of water such that the ball is advanced by skimming the ball relative to the surface of the water toward an opposing team's goal or goals.

It is also an object of the present invention to provide a relatively safe and yet exciting new aquatic sport wherein game balls which are specifically designed to promote a skimming action relative to the surface of the water are propelled by players between each other and toward goals of opposing teams such that the movement of the ball is primarily developed in a skimming motion relative to the surface of the water in which the game is played. A player may carry the ball or push it ahead while swimming.

BRIEF DESCRIPTION OF THE DRAWINGS

A better understanding of the invention will be had with reference to the drawing figures wherein.

DESCRIPTION OF THE PREFERRED EMBODIMENT

Figure 1:
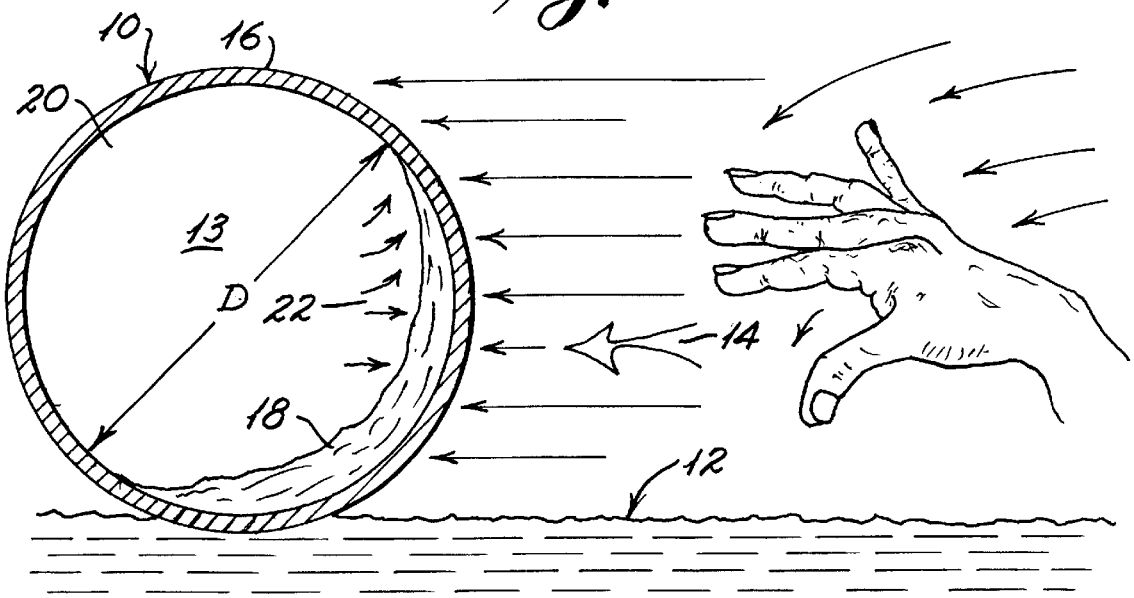
FIG. 1 is a cross sectional illustrational view showing a ball of the present invention and indicating the trajectory of the ball in a skimming or sliding motion as it is propelled by an individual across a surface of water.

With particular reference to FIG. 1, a ball 10 of the present invention will be described in detail. The ball is shown in FIG. 1 as it has been propelled by an individual throwing the ball such that the ball moves generally across the surface 12 of a body of water in a skimming motion. As will be discussed below, the proper propelling motion is important to develop the skimming motion of the ball relative to the water surface. The ball is generally spherical in configuration having an interior volume or cavity 13 which is filled with two fluids having different specific gravities. Preferably one fluid is a gas and the other a liquid. The gas is preferably air and fills a major portion of the cavity 13 as indicated by the number 20. The liquid is preferably a free flowing liquid, such as water, which is not restrained within the cavity 13. It is contemplated that other liquids, semi-liquids and flowable gels can also be used.

As the ball skims across the surface, the liquid therein will move rearwardly, as is shown in the cross section of FIG. 1, with the motion of the liquid being indicated by the arrows 22.

The ball is preferably formed of a natural or synthetic rubber or plastic material having resilient side walls 16. The ball is preferably formed having a diameter "D" which is approximately 5.0 to 8.5 inches for single handed play with diameters of 6.25 to approximately 7.25 being preferred for competitive game play. It is important that the size of the ball be compatible with a player's hand such that the ball can be grasped when being propelled, such as shown in FIG. 1. The side walls are formed so as to be fluid impervious so that the internal pressure and internal weight contents remain as consistent as possible throughout the life of the ball.

The pressure of the fluid such as gas within the cavity may vary depending upon the overall size and weight characteristics of the ball. It is important, however, that the walls of the ball be pliable such that an individual may grasp the ball but such that the walls thereof are not easily deformed without exerting a conscious amount of finger pressure.

For each embodiment of the invention, the amount of free-flowing fluids required to achieve optimum or near-optimum skimming affect varies as to the percentages of the total inside volume for each particular embodiment. That is to say, in some embodiments, the comparative amount of fluids, or liquid versus gas necessary to achieve optimum or near optimum skimming effect for a given size ball and type of material, may be as low as approximately 10% of the inside volume. In other embodiments it is observed that, because of variation in the type of material and the size of the ball, such percentage of liquid to the inside volume may range anywhere from the 10% noted above to more than 20%. None of the balls, however, are able both to skim effectively when containing percentages of liquid above 25% of the inside volume, and to satisfy other practical factors regarding their ease of use and safety in water play.

The physical characteristics of the ball include variable parameters such as size, weight, mass, volume and texture. However, it is preferred that the ball be of a size that is manageable in human hands, of a weight that is not too heavy to throw easily and not too light to preclude it from traveling some distance, of a mass that complements its skimming ability for the size and weight chosen, of a volume that also compliments the parameters of size, weight and mass, and of texture and hardness/softness that enables an individual to easily grasp it without such texture and hardness/softness detracting from the ball's ability to skim the water when properly propelled.

The amount and combination of fluids, such as liquid and gas, may also vary in order to optimize the skimming capability of the ball when propelled relative to the surface of water. In the preferred embodiments, sufficient liquid, such as water, is provided within the cavity of the ball to provide weight to maximize the skimming ability of the ball and such that the ball does not have a tendency to skip relative to the water surface when propelled at a low angle of incidence relative to the surface of the water, i.e. an angle approaching a generally parallel relationship with respect to the surface of the water as shown by the arrow 14 in FIG. 1.

One of the unique effects developed by the game ball used in the present invention is the reaction of the ball upon impact with a side wall of a swimming pool. In this respect, when the ball 10 is propelled at an angle of approximately 45° or less with respect to the side wall, the ball will tend to track or follow the side wall as it moves. One would normally expect that a resilient ball engaging a side wall would tend to bounce at an angle outwardly relative to the side wall and back within the area of the pool. However, because of the dynamics of the ball, the ball will not bounce from the side wall, because the motion of the liquid will change direction such that the liquid tends to move forward and toward the side wall of the pool thus propelling the ball along the side wall. This unexpected motion may be and is utilized as a tactical procedure in playing games utilizing the game ball of the present invention.

If too much liquid is utilized within the cavity of a ball used in the present invention, the ball will have a tendency to sit down or sink causing increased friction or drag relative to the surface of the water which will reduce the skimming effect of the ball. Further, if too little liquid is utilized within the ball, the ball will also lose its optimum skimming effect and will tend to skip relative to the surface of the water or to stop movement. There must be sufficient mass to create a driving force inwardly of the ball to produce the necessary skimming effect. Thus, there must be sufficient liquid within the cavity to provide enough mass to retain the ball in contact with the water surface, but not so much as to create increased drag of the ball across the surface of the water.

The balls have been designed to skim across the surface of water for distances in excess of 75 feet. The relatively narrow range of the diameters of the balls is 5 to 8.5 inches. Within this range, a narrower range of 6.25 to 7.25 inches exists as a preferred size to optimize both the distance that athletic persons may skim such a ball and also the feel and satisfactory weight for competitive play.

The preferred ball is 6.5 inches (16.5 cm) in diameter formed of a water impervious plastisol weighing approximately 3⅞ ounces (110 gms). The ball is filled with air and water to a weight of approximately 14⅛ ounces (410 gms), such that the amount of water included within the cavity is approximately 10¼ ounces (300 gms). The water volume of this ball occupies approximately 14% of the volume of the interior cavity. When properly propelled, this ball successfully achieves the designed objective of traversing the entire length of a 75 foot long junior Olympic size swimming pool.

Another version of a game ball is constructed from a rubber material, having an outer diameter of approximately 7.5 inches (19 cm) and a wall thickness of 0.04 inch. The ball, when filled with approximately 29 ounces (820 gms) of water, constituting approximately 23% of the inside volume of the ball, will skim long distances quite effectively. It takes considerable force, however, to propel it long distances.

Figure 2:
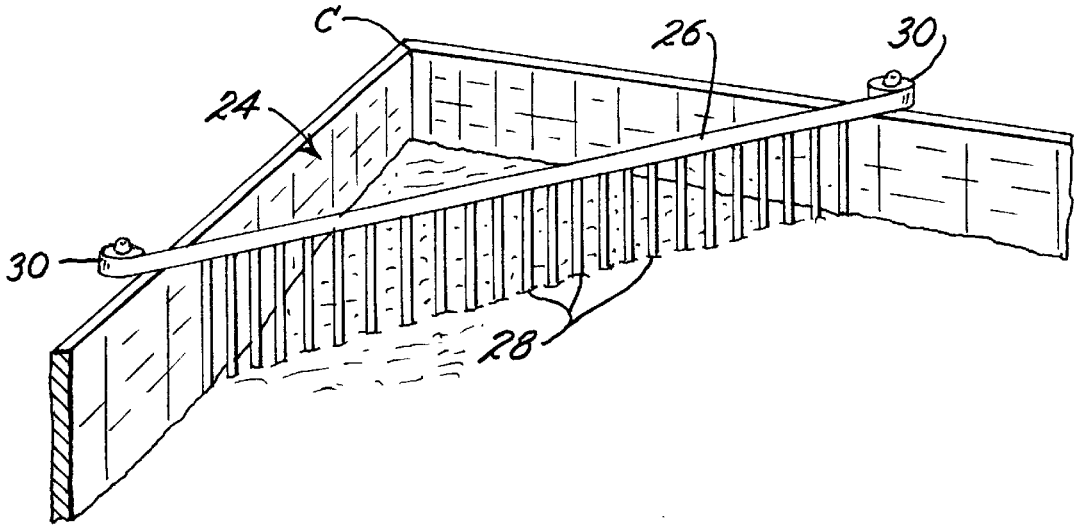
FIG. 2 is a partial perspective view of a goal in accordance with the teachings of the invention.

With continued reference to FIG. 2 of the drawings, a goal 24 for use in the competitive game of the present invention is shown. It is preferred that the goals of the present invention be designed to extend across a corner "C" of a swimming pool, however, in some embodiments, goals may be otherwise mounted along an end or side wall of a swimming pool. The goal includes an upper bar or support 26 which may be formed of a PVC type pipe, nylon cord or similar material which is attached at its opposite ends to end posts 30.

The end posts may be formed having a weighted base designed to rest on a pool deck of the typical swimming pool. The weight in each end post may be provided by filling the base, if hollow, with water, sand or other solid material, or by placing any handy object upon the base that will help keep it wherever placed.

These end posts, before being weighted, are easily moveable relative to the side walls of the pool. Suspended from the bar or support 26 are a plurality of strips of fabric or other flexible material 28 that define the goal mouth and entrance into the goal. These strips enable participants to judge when the ball has completely passed the goal mouth into the goal, resulting in a goal scored and a point or points for such score.

Because the balls used with the game of the present invention are specifically designed to skim across the water surface, in the embodiment of goals shown in FIG. 2, the upper supports or bars 26 are above the water surface by more than the diameter of the game ball so long as the water level is below the pool deck by a distance at least as great as the diameter of the ball. Thus, by way of example, a typical support or bar extends across the goal mouth sufficiently above the water surface to allow one of the game balls discussed above to skim into the goal without touching the support bar. The purpose of the location of the upper bar or support as shown in FIG. 2 is to encourage players to skim rather than skip the ball across the surface at the goal.

It should be noted that a person may intentionally throw the ball with considerable force at a high angle of inclination relative to the surface of water and cause the ball to skip rather than skim. This is encouraged rather than discouraged in competitive play. In such play, the goal mouth may be enlarged by raising the support or bar above the level of the pool deck.

In highly competitive play such as in a large Olympic or junior Olympic size pool, the preferred distance from the water level to the upper bar or support 26 is 30 inches. Large pools of this type often have a gutter along the walls of the pool that is even with and defines the water level. In such a pool, vertical end posts may be attached to the gutter by wire or other suitable fastening material. Thus, the vertical end posts extend 30 inches above the water level from such gutter. Also, in a preferred embodiment, two goals are provided in two corners of a pool for each team with two teams participating and defending their goals.

In the preferred embodiment, the game is played by two teams, each having five players in the area of play during play, with each team defending one half of the pool or delineated area and attacking the other half.

In the preferred embodiment, each team must defend two corner goals although, in some games only a single goal is defended by each team. The goals may include a goal mouth or entrance defined between the posts 30 of 10 feet or less. In those instances where the game is played in a pool having a shallow end and a deep end, the game is divided into periods such that the teams alternatingly defend the deep water goals and the shallow water goals. In one variation, more often in an Olympic size pool, a team's goals are diagonally oriented with respect to one another. In any event, rules of play include periods, such as quarters of a game, to balance the differing skill requirements of those situations where the water depth changes from one end of a pool to another.

A goal is scored each time one of the game balls discussed above is lawfully, in accordance with the rules, skimmed across the surface of the water into one of the opponents' goals. As previously discussed, to further emphasize the importance of the skimming effect that characterizes the balls used in the present invention, the rules of play provide that a goal is disallowed for failure to throw the ball parallel to or in a downward trajectory in relation to the water surface. Any loft on the ball makes a throw an unlawful throw for purposes of determining if a goal has been scored. A goal shall not be awarded unless the ball is skimmed or skipped into the goal on a lawful throw. The value of each goal scored will vary depending upon different versions of the game, depending upon such factors as whether the goal is scored in a deep end goal or a shallow end goal, or scored from the offensive half or defensive half of a large play area of 60 feet or more in length.

After each score, the defending team puts the ball in play. However, play may not resume until the team that scored has the opportunity to reposition its players with respect to its goals.

The game of the present invention is adapted to numerous pool configurations and may also be played in marked water areas, such as in lakes. However, the preferred area of play is generally rectangular with two main variations consistent with standard Olympic (50 meter length) and junior Olympic (approximately 75' in length) pools. The preferred depth of the water in the area of play is from 3.5 to 4.5 feet at the ends and 6 to 8 feet deep in a mid pool or mid area of play. The game may also be played in deeper waters which would involve different skills on behalf of the participants.

Markers 40 or other designations are utilized generally at the mid point of each side of the area of play. A position is also designated or marked 42 at the mid point of each end of the area of play. The four points are used for restarting play after play stoppage.

Figure 3:
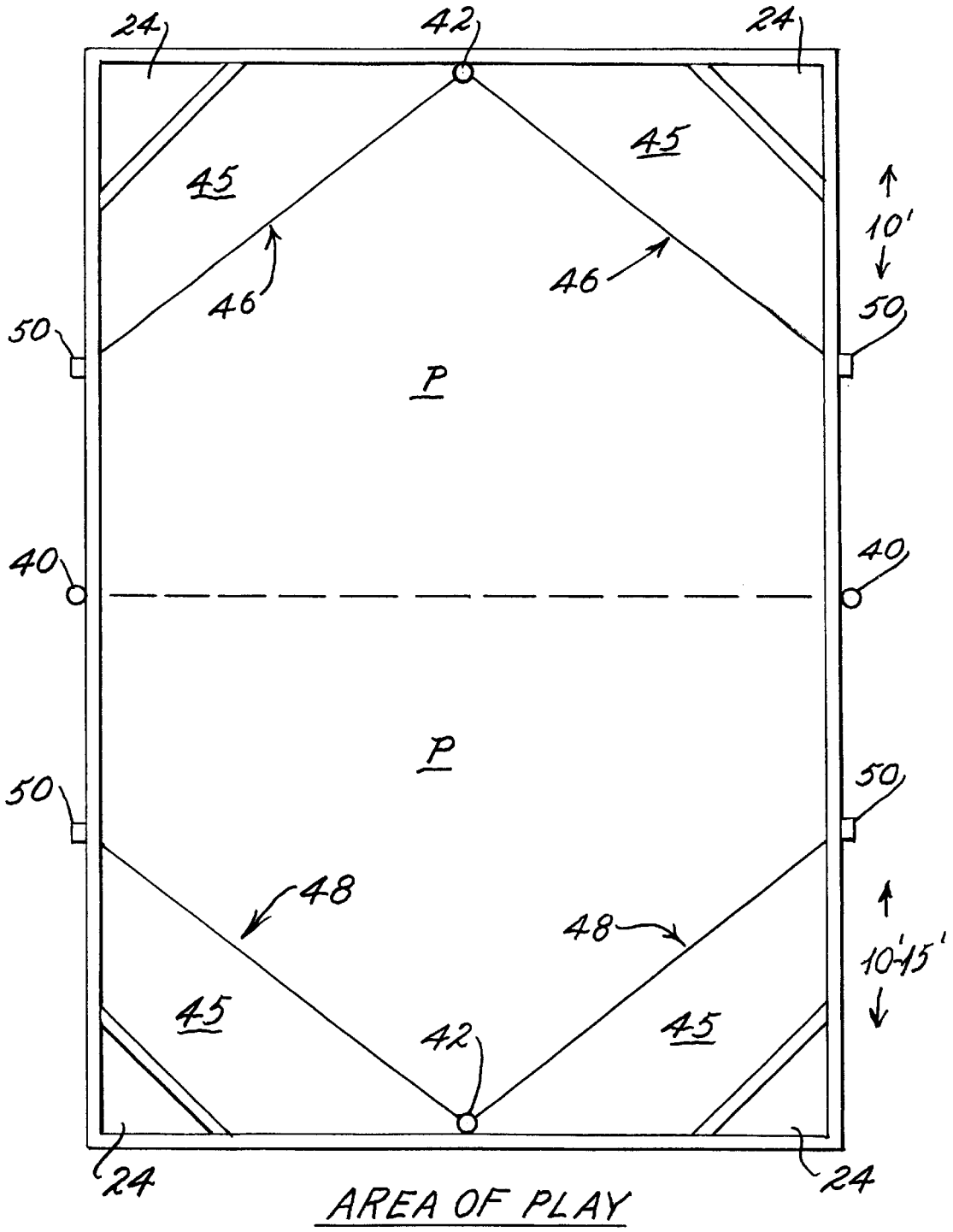
FIG. 3 is a top plan view illustrating a pool and goal arrangement for use in the game of play of the present invention.

With specific reference to FIG. 3, creases 45 are designated in an area near each goal 24. The crease lies goalward of imaginary lines 46 and 48 running from the mid end points to points 50 on the side line located a set distance (typically 10 feet) from the intersection of the side lines with the goal mouth. The rules of play within the crease are distinctive from the rules regarding play in the remainder of the area. No attacking player may be within a crease at any time. Only one defensive player at a time, other than the goalies, may be in the defensive creases. That is, no more than three defenders, even on the opponents' power play (similar to ice hockey), may be within the two creases shown in drawing FIG. 3 at the same time when two goals are utilized for each team.

In the preferred embodiment, two goal judges are positioned at opposite mid end points 42 and are responsible for determining when a player in unlawfully within a crease at an end of a play area. A goal judge shall indicate to the referee, who is the primary official who controls the game and enforces the rules, when this infraction occurs by raising a hand or flag during time when the player is within a crease. A player is within the crease when any part of the body of the player above the water penetrates the imaginary line defining the crease. The referee lid shall question the goal judge if there is any doubt as to whether the goal judge signal pertains to an offensive or defensive player. The referee may overrule the decision of a goal judge.

The two points 50 on each side line for defining the boundaries of each of the two creases by that side line, together with the four mid points, are distinctly marked as shown so that both the officials and the players in the water visually can determine such points. Such a mark may be made by placing a flag or other distinctive line of approximately 5 inches in width at the points.

As previously discussed, in the preferred embodiment, there is a goal 24 in each corner of the play area "P". Each goal will consist of a cross bar mounted on upright posts spaced equal distance from the corner. Other configurations of goals may also be utilized in keeping with the teachings of the present invention.

The game of the present invention, as previously described, is played by two teams each consisting of generally not less than five players in the area of play at any given time. The players may alternate positions within the area of play, providing that in doing so they do not violate an express prohibition of the general rules of the game. Players also may be freely substituted during game play and any player may leave the play area at any time from any point in the area of play. A substitute player may not enter the area of play until the exiting player is effectively out of the play area. There is no requirement that substitutions be made at any particular side or end of a play area though the substitute must enter at the point where the teammate exited the play area. A player that has been replaced may re-enter the game.

Two players on each team in the preferred embodiment are designated goalies who defend the goals at their defensive end of the area of play. Non-goalies may play forward or as part of a defense. As forwards, the players are considered offensive players.

The players of the two teams visibly distinguish themselves from one another by using distinctive colors, such as on head gear, caps, arm bands, shirt, trunks or any combination thereof. No player shall wear any gear which is dangerous to another player. Goalies may wear protective forearm pads when defending a goal and all players are encouraged to wear protective head gear during game play.

The game of the present invention, in the preferred embodiment, consists of four ten minute quarters. A break is given of approximately three minutes between quarters and approximately five to ten minutes between halves. The time, maintained by the referee or by a timing official shall run continuously; however, the referee or time official may add time for stoppages caused by delays such as injuries, ball out of bounds, player substitution and the like.

At the beginning of the game, a selection device, such as a coin toss, is used to determine both the choice of ends to be defended and the choice of initial possession in the first quarter. Thereafter, both the initial possession for each subsequent quarter and the ends to be defended are alternated.

Each quarter starts from the defensive mid point of the attacking team upon the signal of the referee and all players shall be within their defensive half to begin play.

A ball generally is in play whenever it is within the area of play and is out of play when it leaves the area of play or when the game has been stopped by the referee. After the ball is out of play, because of leaving the area of play, a player of the opposite team to that which last touched the ball when it became out of play, shall put the ball into play with a throw-in. The ball is put back into play from within the play area at the nearest mid point (side or end) to the spot where the ball exited the area of play. Until the ball is thrown back into play, players who are defenders at the time the ball is put back into play must remain no less than 5 feet from the player putting the ball into play. When a ball goes out of play as a result of leaving a crease after last touching a member of the defending team, the attacking player who places the ball back into play from a mid-end point may not score by a direct throw into a goal. However, as such location is not within a crease, a goal may be scored by a player from that location at any time other than upon such a throw-in.

When play has been stopped by the referee while the ball is within the play area, the ball generally shall be put back into play by a player of the team last in possession when the stoppage occurred. Depending upon circumstances, at the referee's discretion, an award may be made of possession to an opposite team upon restart or alternatively, the referee may throw the ball anywhere in the play area to restart the game.

The game of the present invention is scored by determining when an attacking team has advanced the game ball past the plane of the mouth of one of the goals being defended by the opposing team provided that such an event does not occur as a result of an illegal throw as previously described. No goal may be scored when an offensive player is within either crease at his attacking end. Each goal scored upon a throw originating from within the offensive half of the area of play shall count a first number of points and each goal scored by a throw originating from a defensive half of the area of play counts a greater number of points. By way of example, a goal scored from an offensive half may count two points and a goal scored from a defensive half may count three points. The referee may indicate by appropriate signal whether a two point or three point goal has been scored.

An official score keeper is usually utilized to maintain a running account of the score of both teams.

In order to promote continuing action, the present invention also contemplates that shots must be taken on goal within a predetermined period of time. In this respect, upon each start or restart of game play, or change of possession, a shot clock is engaged and the team in possession must take a shot on goal within 20 seconds of securing possession or from the start or restart of play. Failure to take a shot within the allotted time results in the loss of possession of the game ball with the opposing team obtaining possession at the nearest mid point to the location of the ball upon expiration of the shot clock time.

Whenever a goal is scored, the team against whom the goal was scored shall put the ball back into play from its defensive mid end 42. Generally, the restart of the shot clock shall occur 5 seconds after the scoring of the goal or the restart of play, which ever occurs first. In the absence of a visible shot clock, the time keeper shall signal when 5 seconds remain on the 20 second shot clock.

In the play of the present invention, the ball is moved from one place to another within the area of play by players carrying the ball with them, passing it or attempting to score a goal. The ball must be skimmed or skipped across the water when passed or when thrown in an attempt to score. Any pass or attempt to score which evidences an upward trajectory to any degree is considered illegal and will result in loss of possession. For example, an opponent may not avoid an opposing player by lofting a ball over the opponent's head.

It is permissible to avoid an opponent by skipping the game ball over or past the opponent. That is, the ball touches the water at some point between the player throwing the ball and the opponent whom he seeks to avoid. A throw is lawful regardless of the distance traveled between the thrower and the first contact of the ball with the water provided that the trajectory of the ball is downwardly toward, or parallel to, the water's surface. A goal lawfully may be scored from any distance provided the ball is thrown downwards or parallel to the surface and touches the water before entering the goal. For example, a player may leap from the water to raise the height at which he releases the ball thus enabling him to lawfully throw the ball in a downward trajectory over or past one or more opponents and either to a teammate or into one of the opposing teams' goals.

Players from the opposing teams may freely move toward a free ball and battle for possession whenever the ball appears to be free from possession by either team. This may occur as a result of an errant pass, a blocked or deflected pass or a restart by the referee. Such a battle for possession should not continue in excess of three to five seconds without the referee halting play. If such a battle does not clearly result in possession by one team, the referee may declare a tie-up. Upon such tie-ups, possession of the ball will be awarded first to one and alternatingly to the other of the opposing teams.

With the exception of battling for a free ball, the game is to be played without direct physical contact other than the touching of an opponent to obtain possession of the ball when that opposing player has possession of the ball. Upon being challenged by an opponent, a player in possession of the ball must rid himself of possession before being clearly physically touched by that opponent. The referee shall award a change of possession upon the failure of the attacked player to rid himself of possession prior to being touched. There shall never be a need for a player to grapple with another player by any manner which could result in injury.

If no player has clear possession of the ball and one or more opposing players appear to be battling unsuccessfully for possession or to be creating a dangerous situation, the referee may halt play. This may occur when a goalie ties-up an attacking opponent. Play shall resume upon such a tie-up with a free throw from the mid side point 40 nearest to the spot of the tie-up. The first such free throw of the game shall be awarded to the team that did not have first possession at the start of the quarter. Thereafter, free throws shall alternate between the two teams with the scorer assisting the referee in keeping track of which team is entitled to the next free throw. Only goalies may defend against free throws.

In the event a referee determines that dangerous play has occurred anywhere in the play area, play will be stopped. The referee may warn the offending player or players or require a 2 minute removal from the game of one or more players with or without substitution. The referee may designate one team as the non-offending team to restart the game from that team's defensive mid end point or declare a tie-up and award the restart to which ever team is next for a restart upon a tie-up.

Upon violation of one of the rules of play, the offending team loses possession, the non-offending team will restart play at the nearest mid point 40 with a throw-in. The offending team must give at least five feet of space to the opponent restarting play. Upon the violation of a rule by the team not in possession of the ball or in the case of flagrant or repeated violation of the rules by either team, the referee may remove the offending player as discussed above without substitution, thus creating a power play situation. Upon the removal of a player from the game for a two minute penalty or for the remaining portion of the game, the team with the greater number of players shall put the ball back into play at its defensive mid end point. A power play shall continue until the penalty time expires or a score occurs.

With two goalies of the attacking team remaining on defense, an attacking team on a power play has three players forward attacking an opposing team that still has four players on its side. If a team defending a power play foregoes offense during the penalty period, it seems clear that it is important that officials enforce the rule limiting the defense to three players within the creases at any given time. This does not preclude a non-goalie defensive player from moving out of a crease to make it lawful for the other non-goalie defender to enter either that crease or the other defensive crease.

As previously discussed, in order to obtain the maximum skimming effect in propelling the balls of the present invention, the balls should be thrown at a low angle of incidence relative to the surface of the water. Such angles should be as close as possible to parallel with the surface of the water so that the balls will slide or skim along the surface with little to no bounce. Skipping of a ball may be accomplished by increasing the angle of incidence and propelling it with enough force to cause it to bounce off the surface. As observed, this is a useful technique for avoiding an opponent who is trying to block a pass or shot.

The foregoing description of the preferred embodiments of the ball and the games of the present invention have been presented to illustrate the principles of the invention and not to limit the invention to the particular embodiments illustrated. It is intended that the scope of the invention be defined by all of the embodiments encompassed within the following claims and their equivalents.

What is claimed is:

1. A method for playing a team sport in water between players of opposing teams utilizing a ball having a hollow interior cavity which is partially filled with a liquid, the method including;

a) defining a play area having opposite ends and spaced sides defining pairs of oppositely oriented corners;

b) providing a goal adjacent each of said corners of the play area of a size to receive the ball when propelled across the surface of the water;

c) providing a ball having a hollow interior cavity having a liquid therein which is present in an amount within the interior cavity to promote skimming of the ball when the ball is propelled at a low angle of incidence toward the surface of water;

d) advancing the ball toward an opposing goal only by carrying the ball, by propelling the ball parallel to or at an angle downwardly toward the surface of water, by skipping the ball across the surface of the water and by skimming the ball across the surface of the water and such that any advancing of the ball to pass or attempt to score which evidences an upward trajectory to any degree when released from a player's possession is not permitted and will result in loss of possession; and e) accumulating points by scoring goals wherein the ball is propelled so as to be in contact with the surface of the water and enters a goal while skipping or skimming across the surface of water in order to receive points toward a point total.

2. The method for playing a team sport of claim 1 including delineating in an area adjacent to each goal a crease zone in which players of an opposing team are prohibited during game play.

3. The method of claim 2 including delineating a mid side point along each of the sides of the play area, and the ball being thrown into the play area to start play from one of the mid side points.

4. The method of claim 3 including the additional step of delineating a mid point along each end of the play area.

5. The method of claim 2 wherein each team has a goalie for each of the goals and wherein a goalie and one additional player from the same team may only be located in a crease zone adjacent their goal at any time during game play.

6. The method of claim 5 including determining time between players making a shot toward one of an opposing team's goals and if a shot is not made within a predetermined time toward said one of an opposing team's goals, changing possession of the ball to the opposing team.

7. The method of claim 6 in which the possession of a ball is retained by one of the two opposing teams until a player having possession of the ball is touched by a player from an opposing team at which time possession is changed to the opposing team.

8. The method of claim 1 in which the possession of a ball is retained by one of the two opposing teams until a player having possession of the ball is touched by a player from an opposing team at which time possession is changed to the opposing team.

* * * * *